US007321377B2

(12) United States Patent
Endo et al.

(10) Patent No.: US 7,321,377 B2
(45) Date of Patent: Jan. 22, 2008

(54) DEVICE AND METHOD FOR LASER MARKING

(75) Inventors: Keisuke Endo, Shizuoka-ken (JP); Hiroyuki Nishida, Shizuoka-ken (JP)

(73) Assignee: FUJIFILM Corporation, Tokyo (JP)

( * ) Notice: Subject to any disclaimer, the term of this patent is extended or adjusted under 35 U.S.C. 154(b) by 374 days.

(21) Appl. No.: 10/831,349

(22) Filed: Apr. 26, 2004

(65) Prior Publication Data

US 2004/0263604 A1 Dec. 30, 2004

(30) Foreign Application Priority Data

Apr. 28, 2003 (JP) ..... 2003-123546
Jun. 5, 2003 (JP) ..... 2003-160366

(51) Int. Cl.
*B41J 2/435* (2006.01)

(52) U.S. Cl. ..... 347/224

(58) Field of Classification Search ..... 347/224–225, 347/240, 251–254; 219/121.6, 121.61, 121.67, 219/121.69; 352/92
See application file for complete search history.

(56) References Cited

U.S. PATENT DOCUMENTS 5,940,115 A 8/1999 Masahiro et al.
6,556,273 B1 * 4/2003 Wheeler et al. ..... 352/92

FOREIGN PATENT DOCUMENTS

| | | | |
|---|---|---|---|
| EP | 1355191 | A1 | 10/2003 |
| EP | 1416323 | A1 | 5/2004 |
| JP | 59-19 253 | | 5/1984 |
| JP | 3191201 | B2 | 5/2001 |
| JP | 3202977 | B2 | 6/2001 |
| JP | 2001-239378 | A | 9/2001 |
| JP | 2001-239700 | A | 9/2001 |

* cited by examiner

*Primary Examiner*—Hai Pham
(74) *Attorney, Agent, or Firm*—Sughrue Mion, PLLC

(57) ABSTRACT

When laser beams with a wavelength of 9.3 μm or 9.6 μm are used, a pulse width t (μsec) which is a radiation time of the laser beam and an energy density E (kw/cm$^2$) of the laser beam on an X-ray film are set such that they meet requirements based on an area A between line segments $A_1$ and $A_2$. Moreover, when laser beams with a wavelength of a 10-micrometer band, such as 10.6 μm, is used, the pulse width and the energy density are set such that they meet requirements based on an area B between line segments $B_1$ and $B_2$. As a result, since the pulse width t is within a range of equal to or larger than 3 μsec and smaller than 30 μsec, a high-quality marking pattern with excellent visibility can be formed while improving the productivity of the X-ray film.

13 Claims, 6 Drawing Sheets

FUJI SHRHA 233 1315

DEVICE AND METHOD FOR LASER MARKING

BACKGROUND OF THE INVENTION

1. Field of the Invention

The present invention relates to a device and a method for laser marking by which laser beams are irradiated onto a web-like material, such as a photosensitive material or a heat-developing photosensitive material, to be printed, and a marking pattern of characters, marks, or the like is formed.

2. Description of the Related Art

When characters, marks, or the like are marked onto a photosensitive material such as an X-ray film, laser beams are used in some cases. The X-ray film absorbs the energy of the irradiated laser beams to cause dot-like fogging and deformation. In a marking method using the laser beams, a marking pattern of characters or marks based on a dot array is formed by irradiating the laser beams onto the X-ray film while the beams are scanned.

In order to improve the visibility of the marking pattern formed on the X-ray film, the dots are required to be formed with a suitable size.

Then, adequate control of the laser beams is needed in order to form the dots with a suitable size and shape on the X-ray film by scanning the laser beams.

For example, in the Japanese Patent No. 3191201, combinations of energy densities and pulse widths of laser beams have been proposed as marking conditions for a case in which the laser beams are irradiated onto a photosensitive material such as an X-ray film, and dots which are almost circular are formed at a predetermined interval for marking. Specifically, energy densities have been proposed for forming dots with excellent visibility onto the X-ray film when laser beams with pulse widths within a range of 30 μsec to 200 μsec are irradiated.

However, when the X-ray film is carried at high velocity in order to improve the productivity of the film, there is a possibility that deviation of dot positions is caused, or that the dots required for forming characters, marks or the like cannot be formed completely because the radiation time of the laser beams becomes too long under a condition in which the pulse widths are within a range of 30 μsec to 200 μsec.

When, for example, a character of 5×5 dots is printed, using a line of laser beams, a linear velocity V (m/min) corresponding to a pulse width t (μsec) for the radiation time of the laser beams is approximately shown as follows: $V=3000/t$. However, when the pulse width t is 30 μsec, the X-ray film cannot be carried at a velocity of 100 m/min or more.

Moreover, when an X-ray film with a higher sensitivity is marked while the film is carried at low velocity, it is preferable for preventing quality degradation such as fogging to use laser beams with smaller energy densities. Especially when the pulse widths are 30 μsec or more, a longer radiation time of the laser beams causes a corresponding increase in the total energy amount supplied to the X-ray film by radiation, and not only the surface, but also the inside of the X-ray film is melted. Accordingly, there is a possibility that the visibility of the dots is reduced or that quality degradation such as fogging is caused.

Incidentally, among processing methods using laser beams, there is a method for processing the surface of a material to be processed by which laser beams are irradiated onto the surface of the material to be processed and the surface is melted or the like by the heat of the laser beams for processing.

As one method for using laser beams, there is a marking method by which dot-like processed signs are formed by irradiating the laser beams on the surface of a material to be printed, and characters, marks, and the like are formed by use of a dot array comprising the processed signs.

For example, dot-like fogging and deformation is caused on a photosensitive material such as an X-ray film by absorbing the energy of the laser beams irradiated onto the film. Accordingly, the laser beams are scanned and irradiated onto the photosensitive material such as an X-ray film to form a marking pattern of characters and marks comprising dot arrays.

Furthermore, when a material to be printed is a web-like photosensitive material or the like, and laser beams are irradiated onto the surface of the material to be printed for forming a marking pattern, the laser beams are scanned and irradiated onto the photosensitive material while the photosensitive material is being carried.

For example, Japanese Patent Application Laid-Open (JP-A) Nos. 2001-239378 and 2001-239700 propose winding a photosensitive material onto the peripheral surface of a back-up roller, and irradiating laser beams onto the surface of the photosensitive material wound onto the roller in such a way that the laser beams are focused at a predetermined position on the surface of the photosensitive material.

For example, Japanese Patent No. 3191201 proposes setting the energy density and the radiation time of laser beams at a predetermined value in order to form dots with excellent visibility on a photosensitive material.

When the laser beams are irradiated on an X-ray film during laser marking, heat is generated on irradiated parts by the laser beams. When the heat is not transmitted to a back-up roller and remains in a photosensitive material, defective performance, such as sensitization or desensitization, or quality degradation, such as thermal fogging, is caused on the photosensitive material.

For example, Japanese Patent No. 3202977 proposes a structure in which a flexible wiring board onto which laser beams are irradiated is held by suction on a receiving board to prevent deviation of focal positions by deflection. In the structure, the receiving board is made of a metal plate with a heat transfer coefficient of 8 W/m×K or more in order to secure heat radiation.

However, there is a possibility that quality degradation, such as thermal fogging is caused on a photosensitive material, even if the outer peripheral part of a back-up roller is formed using a material with this degree of the heat transfer coefficient.

Moreover, a problem occurs in that the heat transfer coefficient is reduced by an air layer which forms between a material to be printed and the back-up roller due to entrained air when the web-like material, such as a photosensitive material, to be printed is wound onto the back-up roller.

SUMMARY OF THE INVENTION

One object of the present invention is to provide a method for laser marking by which productivity is improved without reduction in photographic quality on a photographic photosensitive material and the like and printing quality, and a method for laser marking method, by which printing quality is stabilized.

Another object of the invention is to provide a method and a device for laser marking by which reduction in finished quality caused by heat generated in the material to be printed itself is prevented.

In order to achieve the above-described objects, according to one aspect of the invention, there is provided a method for laser marking in which a predetermined array of dots for forming a marking pattern are formed by irradiating a photosensitive material with a laser beam oscillated through a laser oscillation device, wherein when a wavelength λ of the laser beam is within a range of equal to or larger than 9 μm and smaller than 10 μm, and a pulse width t for driving the laser oscillation device in order to form one dot is within a range of equal to or larger than 3 μsec and smaller than 30 μsec, an energy density E (kw/cm$^2$) of the laser beam on the photosensitive material and the pulse width t are set in an area defined by the following relations: $E=-10t+330$, and $E=-15t+1000$.

According to another aspect of the invention, there is provided a method for laser marking in which a predetermined array of dots for forming a marking pattern are formed by irradiating a photosensitive material with a laser beam oscillated through a laser oscillation device, wherein when a wavelength λ of the laser beam is within a range of equal to or larger than 10 μm and smaller than 11 μm, and a pulse width t for driving the laser oscillation device in order to form one dot is within a range of equal to or larger than 3 μsec and smaller than 30 μsec, an energy density E (kw/cm$^2$) of the laser beam on the photosensitive material and the pulse width t are set in an area defined by the following relations: $E=-15t+1000$, and $E=-25t+1450$.

According to yet another aspect of the invention, there is provided a method for laser marking in which a predetermined array of dots for forming a marking pattern are formed by irradiating a photosensitive material with a laser beam oscillated through a laser oscillation device, wherein when a wavelength λ of the laser beams is within a range of equal to or larger than 9 μm and smaller than 10 μm, and a pulse width t for driving the laser oscillation device in order to form one dot is within a range of equal to or larger than 30 μsec and smaller than 200 μsec, an energy density E (kw/cm$^2$) of the laser beams on the photosensitive material and the pulse width t are set in an area defined by the following relations: $E=-0.03t+10$, and $E=-0.35t+110$.

According to yet another aspect of the invention, there is provided a method for laser marking, comprising: carrying a material to be printed at a predetermined velocity and at a predetermined tension, the material to be printed being wound onto a backup roller, an outer peripheral part of which has a thermal conductivity of 15 W/(m·K) or more; and forming a marking pattern by irradiating the material to be printed a laser beam while the material to be printed is being carried.

According to still another aspect of the invention, there is provided a device for laser marking which form a marking pattern on a photosensitive material, comprising: a carrying device which carries the photosensitive material at a predetermined velocity and a predetermined tension; a laser oscillation device which forms a laser beam; and a laser control device which controls irradiation of the laser beam onto the photosensitive material which is being carried, wherein the carrying device includes a rotatable backup roller onto which the photosensitive material is wound, and which is arranged to oppose the laser oscillation device, and an outer peripheral part of the backup roller has a thermal conductivity of 15 W/(m·K) or more.

The foregoing, and other objects, features and advantages of the invention will be apparent from the following description of preferred embodiments of the invention as illustrated in the accompanying drawings, and the accompanying claims.

DETAILED DESCRIPTION OF THE INVENTION

Figure 1:
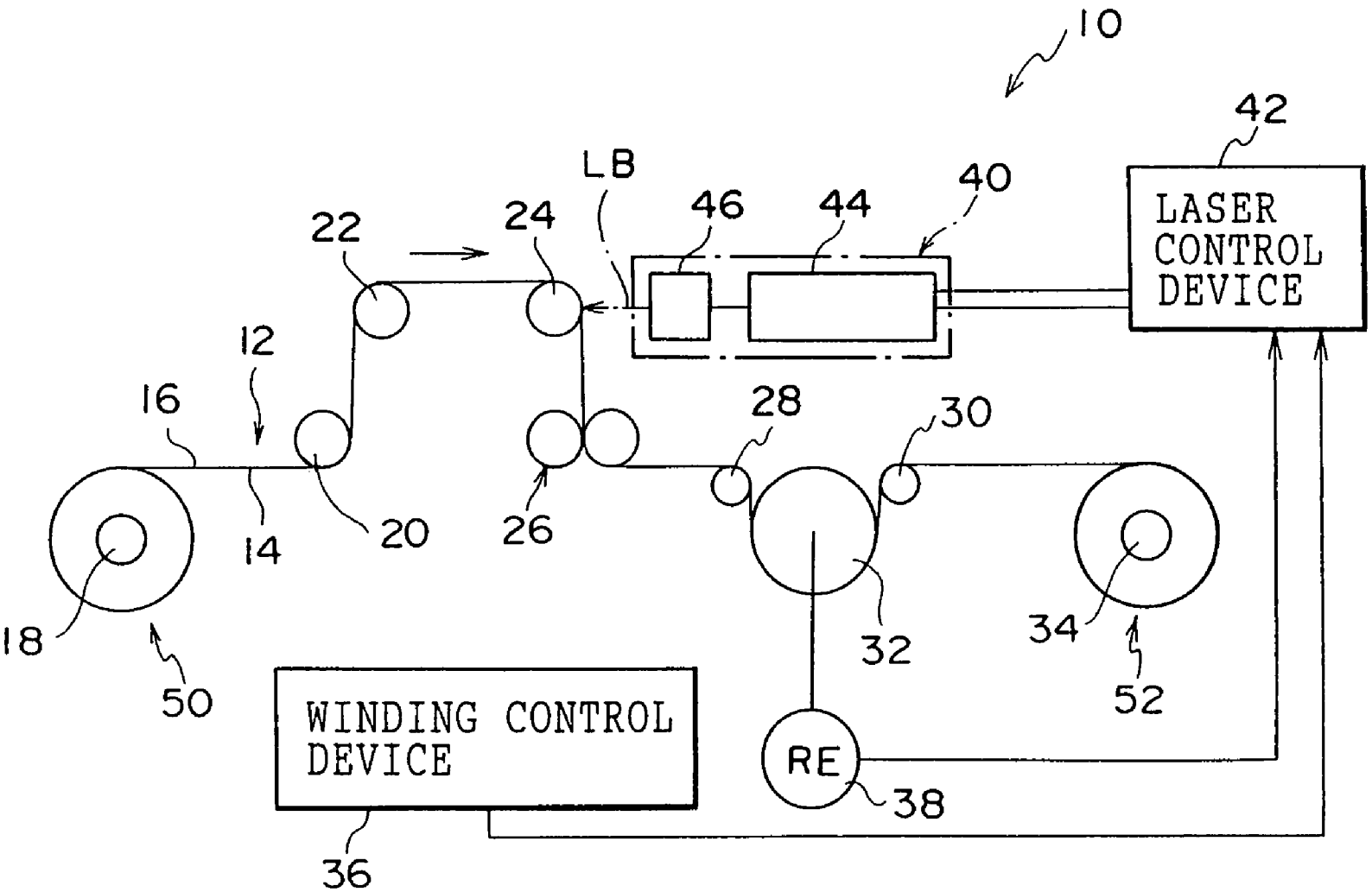
FIG. 1 is a schematic view showing a configuration of a marking device to which one embodiment according to the present invention is applied.

Hereinafter, embodiments of the present invention will be explained. FIG. 1 shows a schematic configuration of a marking device 10 to which an embodiment of the invention is applied. The marking device 10 executes marking processing by which, during carrying along X-ray film 12, laser beams LB are irradiated onto the surface of the long X-ray film 12, as a material to be printed, which has been wound into a roll state, and a marking pattern of characters, marks, or the like is formed.

Figure 2A:
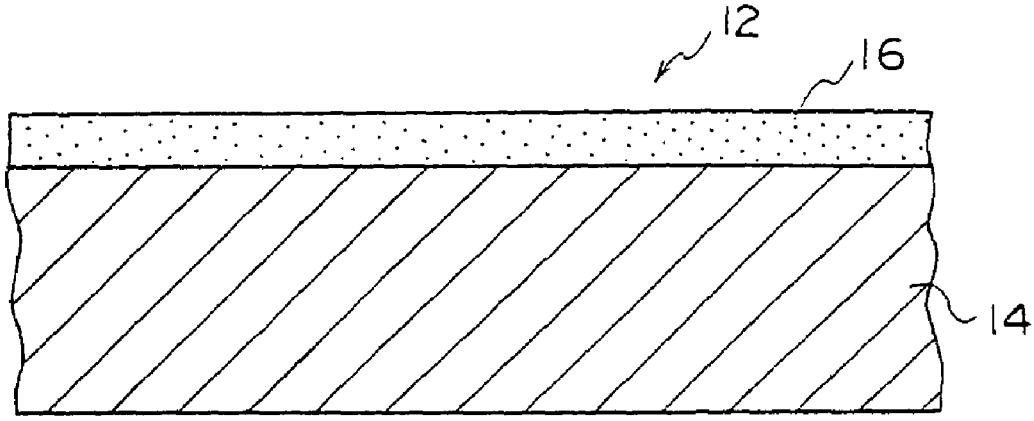
FIG. 2A is a schematic view of an X-ray film.

As shown in FIG. 2A, the X-ray film 12 applied to the embodiment as a photosensitive material has an ordinary configuration in which polyethylene terephthalate (PET) is used for a base layer 14 as a support, and an emulsion is applied to at least one side of the base layer 14 for forming an emulsion layer 16.

As shown in FIG. 1, the X-ray film 12 is wound in a roll shape around a core 18 with the emulsion layer 16 outside, and the X-ray film 12 is installed in the marking device 10 as a delivery roll 50 and is drawn out from the outermost layer.

The X-ray film 12 drawn out from the delivery roll 50 is wound onto a pass roller 20, and the carrying direction of the X-ray film 12 is changed from the proceeding direction (the direction of the arrow shown in FIG. 1) to the upward direction (the direction toward the top of FIG. 1) which is approximately at right angles to the proceeding direction. Then the X-ray film 12 is wound onto a pass roller 22. Moreover, after the X-ray film 12 is wound onto the pass roller 22, the carrying direction of the X-ray film 12 is changed from the upward direction to the proceeding direction, and the film reaches a print roller 24.

In the marking device 10, a position at which the X-ray film 12 is wound onto the print roller 24 is configured to be a position for radiation of the laser beams LB, and the X-ray film 12 whose carrying direction has been changed through the print roller 24 from the proceeding direction to the downward direction, which is approximately at right angles to the proceeding direction, is supported by a pair of rollers 26. Then, the carrying direction of the X-ray film 12 is changed at the rollers 26 to the proceeding direction at right angles to the downward direction, and the X-ray film 12 is delivered to small rollers 28, 30.

A suction drum 32 is arranged between the small rollers 28, 30, and a substantially U-shaped carrying path is formed between the small rollers 28, 30 by the suction drum 32. Then, the X-ray film 12 is wound around the suction drum 32 between the rollers 28, 30.

A large number of small holes (not shown) are provided on the outer peripheral surface of the suction drum 32 through which the X-ray film 12, which is wound onto the outer peripheral surface, is sucked by air for holding. At the same time, the suction drum 32 can be moved downward in FIG. 1 by its own weight of the drum or an urging force of an unillustrated urging unit. As a result, back tension (web tension) is applied to the X-ray film 12. Accordingly, the X-ray film 12 is configured to be kept in tight contact with the print roller 24 when the X-ray film 12 passes through the above-described print roller 24.

The X-ray film 12 delivered from the rollers 26 is carried between the pair of small rollers 28, 30 through the almost U-shaped carrying path, and is delivered from the small roller 30. Then, the X-ray film 12 is wound around a core 34. As a result, a winding roll 52 is formed.

Further, a winding control device 36 is provided in the marking device 10. The winding control device 36 controls drive units, which drive the cores 18, 34 and the suction drum 32, to execute drawing out of the X-ray film 12 from the delivery roll 50, carrying of the drawn X-ray film 12, and winding of the X-ray film 12 around the core 34.

In the marking device 10, the cores 18, 34 are driven to rotate so that the X-ray film 12 is basically carried at the same linear velocity, and the suction drum 32 is rotated in a state in which the X-ray film 12 is sucked for holding.

The suction drum 32 is provided with a rotary encoder 38 which outputs a pulse signal corresponding to a rotation angle of the suction drum 32. In the marking device 10, a carrying velocity and a carrying length of the X-ray film 12 can be monitored, using the pulse signal output from the rotary encoder 38.

Furthermore, the marking device 10 is provided with a marking head 40 which emits laser beams LB as a marking unit, and a laser control device 42 which controls the laser beams LB emitted from the marking head 40. The above-described rotary encoder 38 is connected to the laser control device 42 into which a pulse signal corresponding to the carrying velocity of the X-ray film is input.

Figure 3:
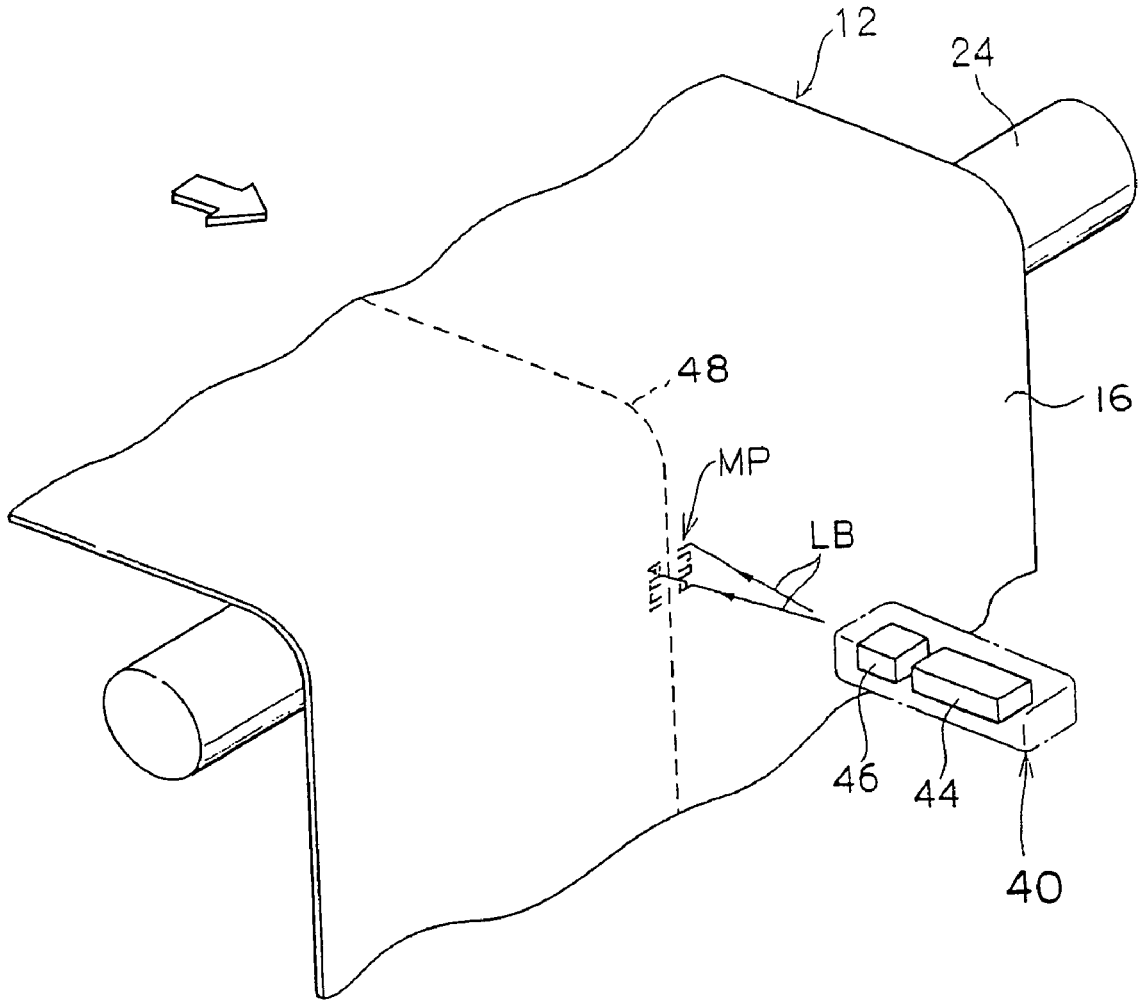
FIG. 3 is a schematic perspective view showing a principal part of a configuration in the vicinity of a print roller.

As shown in FIGS. 1 and 3, the marking head 40 is arranged in such a way that an emitting opening at the tip part for the laser beams LB and the X-ray film 12 wound onto the print roller 24 oppose to each other. Moreover, the marking head 40 comprises a laser oscillation unit 44 and a beam deflection unit 46 including an optical system such as an unillustrated condensing lens, and the laser beams LB from the laser oscillation unit 44 are emitted to the X-ray film 12 wound onto the roller 24.

The laser control device 42 (not shown in FIG. 3) applied to the embodiment outputs a pulse signal as a driving signal at a predetermined timing. The laser oscillation unit 44 emits the laser beams LB having a constant wavelength according to the input pulse signal as a driving signal at a duration (pulse width) of the pulse signal.

The beam deflection unit 46 is provided with, for example, an acoustic optic device (AOD), and the laser control device 42 outputs a deflection signal at a predetermined timing. The unit 46 scans the laser beams LB along a width direction orthogonal to the carrying direction of the X-ray film 12, based on the deflection signal. Here, the laser beams LB scanned by the unit 46 come into a focus with a predetermined spot diameter on the X-ray film 12 due to a condensing lens to thereby form an image.

A pattern signal corresponding to a marking pattern MP of characters, marks or the like to be recorded on the X-ray film 12 (refer to FIG. 3) is input from, for example, the winding control device 36 to the laser control device 42.

The laser control device 42 outputs the driving signal to the laser oscillation unit 44, and also outputs the deflection signal to the beam deflection unit 46 according to the pattern signal, while monitoring the carrying length of the X-ray film 12, based on the pulse signal input from the above-described rotary encoder 38.

As a result, the laser beams LB are scanned and irradiated from the marking head 40 onto the X-ray film 12 while being turned on-off according to the marking pattern. At this time, as shown in FIG. 3, the laser control device 42 outputs the signals, with the direction of the laser beams LB (deflection direction) by the beam deflection unit 46 in the marking head 40 being defined as a main scanning direction, and the carrying direction of the X-ray film 12 being defined as a sub scanning direction, so that the laser beams LB are irradiated onto the X-ray film 12 to form the marking pattern MP on the X-ray film 12. Here, an example in which letters of the alphabet are used as the marking pattern MP is shown in FIG. 3.

Figures 4A, 4B:
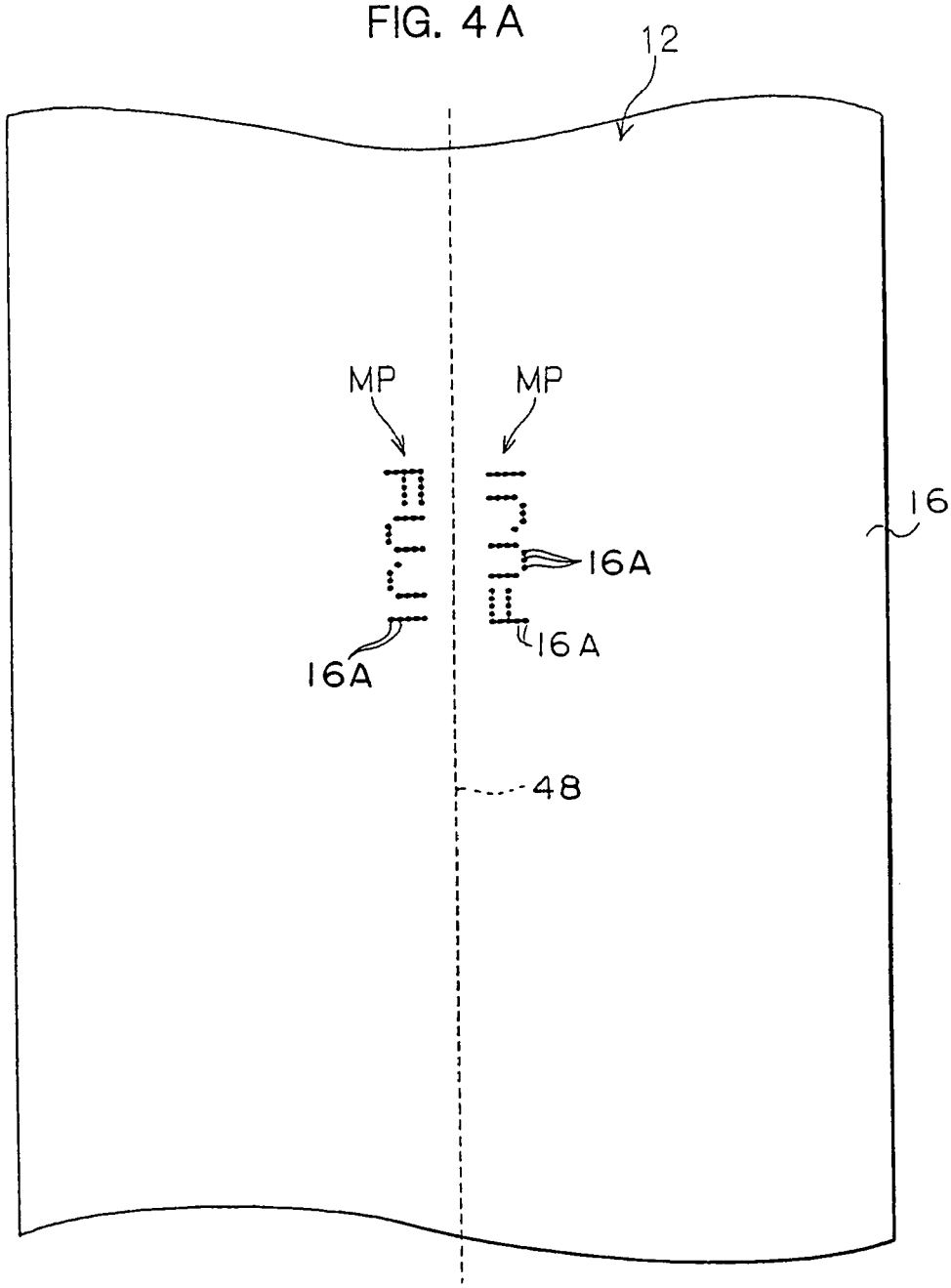
FIG. 4A is a schematic view showing one example of the X-ray film on which a marking pattern is formed.
FIG. 4B is a schematic view showing one example of an array of dots for characters which are formed as the marking pattern.

As shown in FIGS. 3, 4A, and 4B, the marking pattern MP can be formed, using characters, marks, graphic symbols and the like, which comprise a dot array such as a 5×5 dot array. Moreover, the pattern MP may have an arbitrary configuration which uses a plurality of characters, number symbols, marks, and the like, which comprise a dot array as shown in FIG. 4B.

Here, when the X-ray film 12 is cut at a predetermined position in the width direction (a cut line 48 is shown by a dashed line) along the longitudinal direction, as shown in FIG. 3 and FIG. 4A, and is processed into a roll or a sheet with a narrow breadth, the marking pattern MP can be formed on both sides of the cut line 48 such that top and bottom directions of the marking patterns are opposite to each other.

Moreover, as shown in FIGS. 1 and 3, the marking head 40 and the X-ray film 12 are configured in the marking device 10 to oppose each other at a position at a short distance from the print roller 24 when the X-ray film 12 is wound onto the print roller 24. As a result, fogging, which is generated in the X-ray film 12 by heating of dust and the like which is attached to the peripheral surface of the print roller 24 through the laser beams LB penetrating the X-ray film 12, is prevented.

Furthermore, $CO_2$-laser beams are used as one example of the laser beams LB in the marking device 10, and a laser oscillation tube for outputting the $CO_2$-laser beams with a predetermined wavelength is used in the laser oscillation unit 44 of the marking head 40.

Figure 2B:
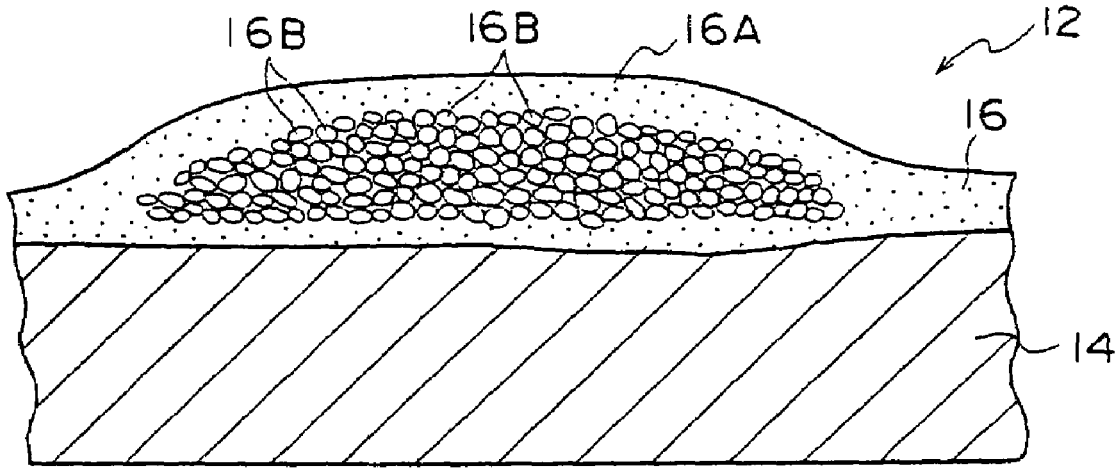
FIG. 2B is a schematic view showing one example of dots with excellent visibility which are formed on the X-ray film.

As shown in FIG. 2B, in the marking device 10, convex dots 16A are formed on the X-ray film 12 by the laser beams LB emitted from the marking head 40, and characters, marks, and the like forming the marking pattern MP are formed by an array of the dots 16A.

Here, the wavelength (oscillation wavelength) $\lambda$(μm) of the laser beams LB which oscillate in the laser oscillation unit 44, the pulse width t (μsec), which drives the laser oscillation unit 44, as the radiation time of the laser beams LB for forming one dot 16A, and, the energy density E (kw/cm$^2$) of the laser beams LB irradiated onto the x-ray film 12 are set in the embodiment in such a way that predetermined relations which have been set beforehand are satisfied. As a result, while the X-ray film 12 is carried according to the predetermined linear velocity, the marking pattern MP comprising the dots 16A and the dot arrays with excellent visibility is formed on the X-ray film 12.

That is, when the dots 16A are formed by irradiating the laser beams LB oscillated in the laser oscillation unit 44 onto the X-ray film 12, the X-ray film 12 absorbs the energy of the laser beams LB and is melted. At this time, the melting speed depends on the amount of the energy absorbed.

Moreover, the amount of energy absorbed by the X-ray film 12 changes according to the wavelength λ of the laser beams LB, the energy density E of the laser beams LB, and the pulse width t of the radiation time of the laser beams LB.

On the other hand, a higher linear velocity of the X-ray film 12 requires that the pulse width t be shorter. Furthermore, the wavelength λ of the laser beams LB such as $CO_2$ laser beams is roughly divided into, for example, a 9-micrometer wavelength band such as 9.3 μm ($9.3\times10^{-6}$ m) and 9.6 μm, and a 10-micrometer wavelength band such as 10.6 μm.

Figure 5:
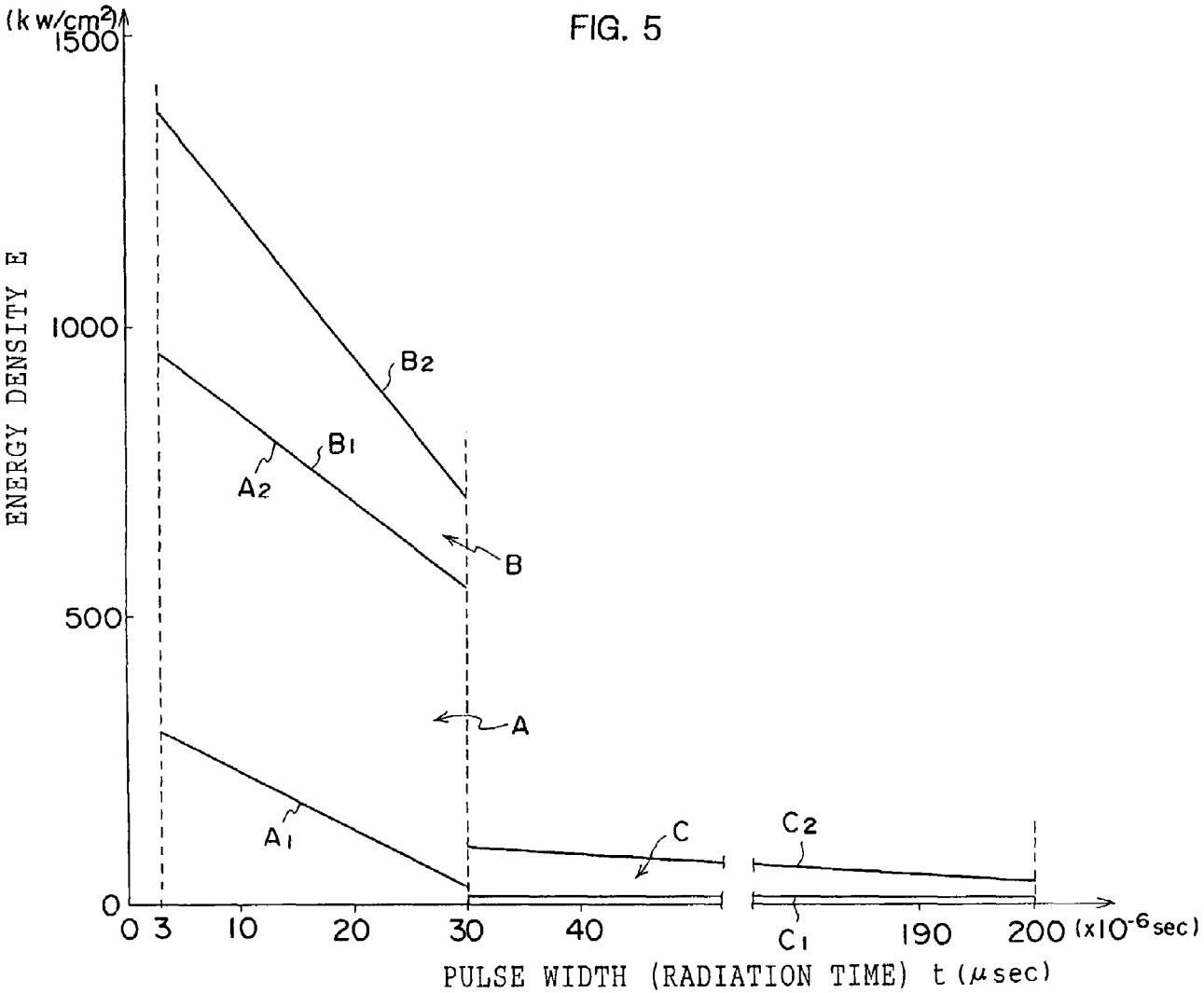
FIG. 5 is a diagram showing areas in which dots with excellent visibility can be formed, based on pulse widths and energy densities.

Here areas A, B, and C, in which the dots 16A with excellent visibility can be formed, are set, based on the wavelength λ, the pulse width t, and the energy density E as shown in FIG. 5. Then, marking is executed according to the area A, B or C. Here, the areas A and C are applied to the laser beams LB in the 9-micrometer wavelength band, and the area B is applied to the laser beams LB in the 10-micrometer wavelength band.

In the marking device 10 with the above-described configuration, the winding control device 36 controls starting of drawing-out of the X-ray film 12 from the delivery roll 50. As a result, while being wound onto the print roller 24, the suction drum 32, and the like, the X-ray film 12 is carried, and wound around the core 34 to form the winding roll 52.

At this time, the suction drum 32 is controlled by the winding control device 36 to start air sucking while rotating, and the X-ray film 12 which is wound onto the outer peripheral surface is sucked and held. As a result, the X-ray film 12 is carried at a constant linear velocity. Moreover, the suction drum 32 applies predetermined tension to the X-ray film 12 by its own weight or an urging force.

As a result, the rotational velocity (peripheral velocity) of the suction drum 32 becomes the linear velocity of the X-ray film 12, at which the film 12 is carried while being wound onto the print roller 24.

On the other hand, the laser control device 42 detects the rotational velocity of the suction drum 32 by the rotary encoder 38 to monitor the carried length of the X-ray film 12. When the carried length of the X-ray film 12 reaches a predetermined length, the driving signal for the laser oscillation unit 44 and the deflection signal for the beam deflection unit 46 are output, such that both signals correspond to the pattern signal input from the winding control device 36.

The laser oscillation unit 44 oscillates the laser beams LB according to the driving signal after the signal is input. The beam deflection unit 46 deflects the laser beams LB according to the deflection signal.

As a result, the X-ray film 12 is scanned and irradiated by the laser beams LB according to the pattern signal, and the marking pattern MP having the dot arrays according to the pattern signal is formed on the X-ray film 12.

Incidentally, the X-ray film 12 absorbs the energy of the laser beams LB due to the beams LB being irradiated onto the emulsion layer 16 to cause melting and deposition on the emulsion layer 16. Minute air bubbles 16B are generated in the emulsion layer 16 of the X-ray film 12 during the melting and deposition process, and the surface becomes convex due to the minute air bubbles 16B.

Dots with excellent visibility can be obtained by making a diameter of the minute air bubbles 16B about 1 μm to 5 μm, by making an amount of convexity of the dots 16A due to the air bubbles 16B about 10 μm, and by making a diameter of the dots 16A about 200 μm ($200\times10^{-6}$ m).

That is, in the X-ray film 12, a large number of air bubbles 16B are generated in the emulsion layer 16 to form a large numbers of boundary films between the air bubbles 16B, and irregular reflection of light is promoted. As a result, since there is a large difference in amounts of reflected light between the inside and the outside of the dots 16A in the X-ray film 12, the visibility of the dots 16A is improved regardless of whether or not developing has been carried out and regardless of the lightness or darkness of the density.

Moreover, the above-described dots 16A formed on the X-ray film 12 become opaque, and visual identification of the dots 16A can be reliably realized not only when viewed from the upper side of the X-ray film 12, but also when viewed in a state in which the X-ray film 12 is tilted.

On the other hand, when the radiation time of the laser beams LB is short, and the energy amount absorbed by the emulsion layer 16 is reduced, the diameters of the dots become small, and melting is not caused. Accordingly, visibility of the dots 16A decreases.

Moreover, when the radiation time of the laser beams LB is long, and the energy amount absorbed by the emulsion layer 16 is increased, melting of the emulsion layer 16 is advanced to generate a space between the base layer 14 and the emulsion layer 16, or to expose the base layer 14.

The space generated between the base layer 14 and the emulsion layer 16 is different from the air bubbles 16B generated in the emulsion layer 16, that is, the space is larger, in comparison with the size of the air bubbles 16B. When the space is generated, although the visibility of the dots 16A is improved immediately after radiation of the laser beams LB and before developing, the emulsion layer 16 at the upper part of the space is scattered or comes off due to developing processing to expose the base layer 14. As a result, the visibility of the dots 16A is reduced, or the dots 16A disappear.

Accordingly, in the marking device 10, the output of the marking head 40 (the output of the laser oscillation unit 44) and the radiation time of the laser beams LB are set in order to impart energy for forming the proper dots 16A with excellent visibility.

FIG. 2B shows one example of the dot 16A in an ideal state, but the shape of the dot 16A formed on the X-ray film 12 is not limited to the one shown in FIG. 2B. As the dot 16A which can obtain the predetermined visibility, it is only required that the base layer 14 is not exposed and the dot 16A is protruded from the surface of the base layer 14.

Here, the wavelength λ (μm) of the laser beams LB, using laser oscillation units with different oscillation wavelengths (wavelength λ) and different outputs are switched, and the pulse width t (μsec) of the radiation time and the energy density E ($kw/cm^2$) of the laser beams LB are changed to make visibility evaluation of the dots 16A at irradiating the laser beams LB, fogging evaluation, and over-all evaluation of finished quality including the product quality. Based on the above-described evaluation results, conditions for marking of the dots 16A on the X-ray film 12 with excellent visibility and without reduction in the product quality are set.

Figure 6:
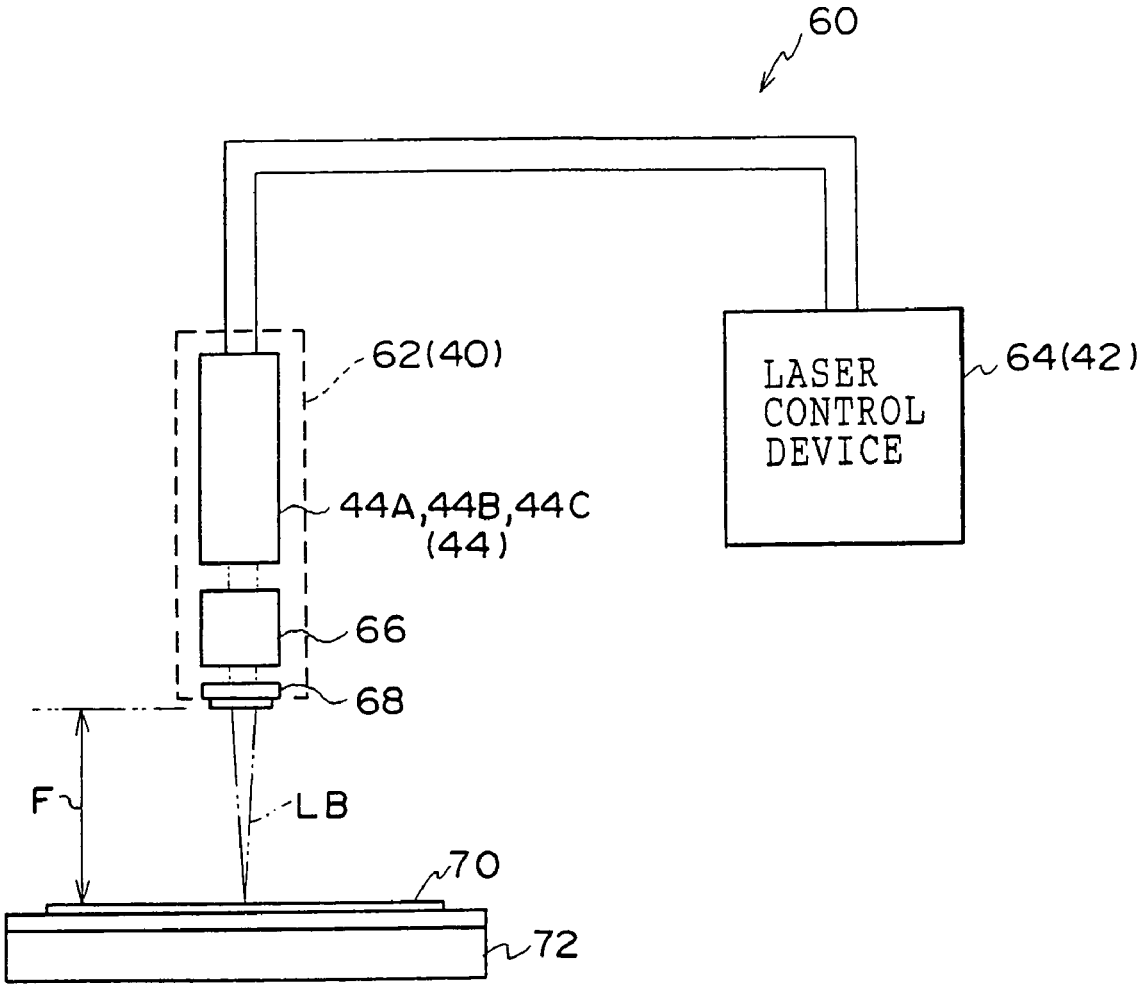
FIG. 6 is a schematic view showing a configuration of a testing device used for evaluation of dots.

FIG. 6 shows a schematic configuration of a testing device 60 applied to the above-described evaluation. With regard to the testing device 60, laser oscillation tubes 44A, 44B, 44C are alternately disposed in a marking head 62 as a laser oscillation unit 44. In the evaluation, the laser beams LB having wavelength λ of 9.3 μm and 9.6 μm are used as those of the 9-micrometer band, and the laser beams LB having wavelength λ of 10.6 μm are applied as those of the 10-micrometer band. The oscillation wavelength (wavelength λ) of the laser oscillation tube 44A is 9.3 μm, the oscillation wavelength of the laser oscillation tube 44B is 9.6 μm, and the oscillation wavelength of the laser oscillation tube 44C is 10.6 μm.

These laser oscillation tubes 44A through 44C emit the laser beams LB with a beam diameter of about 4 mm.

A laser control device 64 outputs a pulse signal with a predetermined pulse width t (μsec) for driving the laser oscillation tubes 44A through 44C. At this time, the laser control device 64 can arbitrarily adjust the pulse width t.

A polarizer 66, instead of the beam deflection unit 46, is used for adjusting the energy of the laser beams LB which are emitted to the X-ray film 12, and, at the same time, a condensing lens 68 is arranged at the emitting side of the laser beams LB for condensing the laser beams LB in such a way that the spot diameter becomes about 2 mm at a position at a distance F of 50 mm. The energy of the laser beams LB which are emitted from the marking head 62 can be adjusted by changing the outputs of the laser oscillation tubes 44A through 44C, but the polarizer 66 is configured to be used in evaluation.

Moreover, in the testing device 60, an evaluation sample 70 is mounted for use on an X-Y mobile table 72 by which the evaluation sample 70 can be moved in the horizontal direction.

The evaluation sample 70 comprises a support (base layer 14) of PET with a thickness of about 175 μm, and the emulsion layer 16 with a thickness of about 2 μm to 5 μm obtained by application of an emulsion on the one side of the support. The evaluation sample is inserted into or drawn out from a place for radiation of the laser beams LB by the X-Y mobile table 72. At this time, the evaluation sample 66 is sucked and held on the X-Y mobile table 72, and characters and marks (marking pattern MP) for evaluation are formed on the evaluation sample 70 not by scanning of the laser beams LB, but by moving the evaluation sample 70 horizontally, using the X-Y mobile table 72.

Moreover, evaluation for the visibility and the fogging is made by visual check, and the results are expressed as follows:

For the visibility evaluation,

○: dots and dot patterns with preferable visibility, which are obtained after air bubbles are generated only in the emulsion layer and the emulsion layer becomes turbid in white color, and can be identified at a glance, Δ: dots and dot patterns with insufficient visibility, in which a part of the base layer (support) is exposed and there is a part which has darkened, and X: dots and dot patterns with remarkably inferior visibility, in which the base layer is completely exposed and their existence can not be identified at a glance, or dots and dot patterns whose visual identification is difficult because there is no substantial deformation in the emulsion layer;

For the fogging evaluation,

○: no generation of fogging, and

X: appearance of fogging by which there is a possibility of quality degradation; and, For the over-all evaluation, ○: formation of dot patterns with excellent visibility, and no deterioration in the product quality, and X: formation of dot patterns with poor visibility, and deterioration in the product quality.

Tables 1 through 4 show testing results which were obtained under conditions in which, while the pulse widths t (μsec) are constant, the wavelengths λ (μm) of the laser beams LB, and the energy densities E (kw/cm$^2$) of the laser beams LB on the evaluation sample 70 are changed. Here, the pulse widths t in Tables 1 through 4 are 3 μsec, 10 μsec, 20 μsec, and 30 μsec, respectively.

TABLE 1

| Pulse width (t) $3 \times 10^{-6}$ Sec | Radiation wave-length (μm) | | | | | |
|---|---|---|---|---|---|---|
| Energy density | Visibility evaluation | | Fogging evaluation | | Over-all evaluation | |
| (Kw/cm$^2$) | 9.3, 9.6 | 10.6 | 9.3, 9.6 | 10.6 | 9.3, 9.6 | 10.6 |
| 200 | Δ | x | ○ | — | x | x |
| 300 | ○ | x | ○ | — | ○ | x |
| 500 | ○ | x | ○ | — | ○ | x |
| 800 | ○ | x | ○ | — | ○ | x |
| 900 | ○ | Δ | ○ | ○ | ○ | x |
| 1000 | Δ | ○ | x | ○ | x | ○ |
| 1200 | Δ | ○ | x | ○ | x | ○ |
| 1300 | Δ | ○ | x | ○ | x | ○ |
| 1400 | Δ | Δ | x | x | x | x |

TABLE 2

| Pulse width (t) $10 \times 10^{-6}$ sec | Radiation wave-length (μm) | | | | | |
|---|---|---|---|---|---|---|
| Energy density | Visibility evaluation | | Fogging evaluation | | Over-all evaluation | |
| (Kw/cm$^2$) | 9.3, 9.6 | 10.6 | 9.3, 9.6 | 10.6 | 9.3, 9.6 | 10.6 |
| 200 | Δ | x | ○ | — | x | x |
| 300 | ○ | x | ○ | — | ○ | x |
| 500 | ○ | x | ○ | — | ○ | x |
| 800 | ○ | Δ | ○ | ○ | ○ | x |
| 900 | Δ | ○ | x | ○ | x | ○ |
| 1000 | Δ | ○ | x | ○ | x | ○ |
| 1200 | Δ | ○ | x | ○ | x | ○ |
| 1300 | Δ | Δ | x | ○ | x | x |
| 1400 | Δ | Δ | x | x | x | x |

TABLE 3

| Pulse width (t) $20 \times 10^{-6}$ sec | Radiation wave-length (μm) | | | | | |
|---|---|---|---|---|---|---|
| Energy density | Visibility evaluation | | Fogging evaluation | | Over-all evaluation | |
| (Kw/cm$^2$) | 9.3, 9.6 | 10.6 | 9.3, 9.6 | 10.6 | 9.3, 9.6 | 10.6 |
| 200 | ○ | x | ○ | — | ○ | x |
| 300 | ○ | x | ○ | — | ○ | x |
| 500 | ○ | x | ○ | — | ○ | x |
| 800 | Δ | ○ | x | ○ | x | ○ |
| 900 | Δ | ○ | x | ○ | x | ○ |
| 1000 | Δ | Δ | x | x | x | x |
| 1200 | Δ | Δ | x | x | x | x |
| 1300 | Δ | Δ | x | x | x | x |
| 1400 | Δ | Δ | x | x | x | x |

TABLE 4

| Pulse width (t) 30 × $10^{-6}$ sec | Radiation wave-length (μm) | | | | | |
|---|---|---|---|---|---|---|
| Energy density | Visibility evaluation | | Fogging evaluation | | Over-all evaluation | |
| (Kw/cm$^2$) | 9.3, 9.6 | 10.6 | 9.3, 9.6 | 10.6 | 9.3, 9.6 | 10.6 |
| 200 | ○ | x | ○ | — | ○ | x |
| 300 | ○ | x | ○ | — | ○ | x |
| 500 | ○ | x | ○ | — | ○ | x |
| 800 | Δ | ○ | x | ○ | x | ○ |
| 900 | Δ | ○ | x | ○ | x | ○ |
| 1000 | Δ | Δ | x | x | x | x |
| 1200 | Δ | Δ | x | x | x | x |
| 1300 | Δ | Δ | x | x | x | x |
| 1400 | Δ | Δ | x | x | x | x |

Moreover, Tables 5 through 12 show testing results which were obtained under conditions in which, while the energy densities E (kw/cm$^2$) of the laser beams LB are constant, the wavelengths λ (μm) of the laser beams LB, and the pulse widths t (μsec) of the laser beams LB are changed. Here, the energy densities E (kw/cm$^2$) in Tables 5 through 9 are 200 kw/cm$^2$, 500 kw/cm$^2$, 600 kw/cm$^2$, 750 kw/cm$^2$, and 1000 kw/cm$^2$, respectively. Moreover, the energy densities E (kw/cm$^2$) in Tables 10 through 12 are 5 kw/cm$^2$, 80 kw/cm$^2$, and 50 kw/cm$^2$, respectively.

TABLE 5

| Energy density 200 kw/cm$^2$ | Radiation wave-length (μm) | | | | | |
|---|---|---|---|---|---|---|
| Pulse width (t) | Visibility evaluation | | Fogging evaluation | | Over-all evaluation | |
| (×$10^{-6}$ sec) | 9.3, 9.6 | 10.6 | 9.3, 9.6 | 10.6 | 9.3, 9.6 | 10.6 |
| 1 | x | x | — | — | x | x |
| 3 | x | x | — | — | x | x |
| 5 | x | x | — | — | x | x |
| 10 | x | x | — | — | x | x |
| 15 | ○ | x | ○ | — | ○ | x |
| 20 | ○ | x | ○ | — | ○ | x |
| 25 | ○ | x | ○ | — | ○ | x |
| 30 | ○ | x | ○ | — | ○ | x |
| 35 | Δ | x | x | — | x | x |

TABLE 6

| Energy density 500 kw/cm$^2$ | Radiation wave-length (μm) | | | | | |
|---|---|---|---|---|---|---|
| Pulse width (t) | Visibility evaluation | | Fogging evaluation | | Over-all evaluation | |
| (×$10^{-6}$ sec) | 9.3, 9.6 | 10.6 | 9.3, 9.6 | 10.6 | 9.3, 9.6 | 10.6 |
| 1 | x | x | — | — | x | x |
| 3 | ○ | x | ○ | — | ○ | x |
| 5 | ○ | x | ○ | — | ○ | x |
| 10 | ○ | x | ○ | — | ○ | x |
| 15 | ○ | x | ○ | — | ○ | x |
| 20 | ○ | x | ○ | — | ○ | x |
| 25 | ○ | x | ○ | — | ○ | x |
| 30 | ○ | x | ○ | — | ○ | x |
| 35 | Δ | x | x | — | x | x |

TABLE 7

| Energy density 600 kw/cm$^2$ | Radiation wave-length (μm) | | | | | |
|---|---|---|---|---|---|---|
| Pulse width (t) | Visibility evaluation | | Fogging evaluation | | Over-all evaluation | |
| (×$10^{-6}$ sec) | 9.3, 9.6 | 10.6 | 9.3, 9.6 | 10.6 | 9.3, 9.6 | 10.6 |
| 1 | x | x | — | — | x | x |
| 3 | ○ | x | ○ | — | ○ | x |
| 5 | ○ | x | ○ | — | ○ | x |
| 10 | ○ | x | ○ | — | ○ | x |
| 15 | ○ | x | ○ | — | ○ | x |
| 20 | ○ | x | ○ | — | ○ | x |
| 25 | ○ | Δ | ○ | ○ | ○ | x |
| 30 | Δ | ○ | x | ○ | x | ○ |
| 35 | Δ | ○ | x | x | x | x |

TABLE 8

| Energy density 750 kw/cm$^2$ | Radiation wave-length (μm) | | | | | |
|---|---|---|---|---|---|---|
| Pulse width (t) | Visibility evaluation | | Fogging evaluation | | Over-all evaluation | |
| (×$10^{-6}$ sec) | 9.3, 9.6 | 10.6 | 9.3, 9.6 | 10.6 | 9.3, 9.6 | 10.6 |
| 1 | x | x | — | — | x | x |
| 3 | ○ | x | ○ | — | ○ | x |
| 5 | ○ | x | ○ | — | ○ | x |
| 10 | ○ | x | ○ | — | ○ | x |
| 15 | ○ | x | ○ | — | ○ | x |
| 20 | Δ | ○ | x | ○ | x | ○ |
| 25 | Δ | ○ | x | ○ | x | ○ |
| 30 | Δ | Δ | x | x | x | x |
| 35 | Δ | Δ | x | x | x | x |

TABLE 9

| Energy density 1000 kw/cm$^2$ | Radiation wave-length (μm) | | | | | |
|---|---|---|---|---|---|---|
| Pulse width (t) | Visibility evaluation | | Fogging evaluation | | Over-all evaluation | |
| (×$10^{-6}$ sec) | 9.3, 9.6 | 10.6 | 9.3, 9.6 | 10.6 | 9.3, 9.6 | 10.6 |
| 1 | x | x | — | — | x | x |
| 3 | Δ | ○ | x | ○ | x | ○ |
| 5 | Δ | ○ | x | ○ | x | ○ |
| 10 | Δ | ○ | x | ○ | x | ○ |
| 15 | Δ | ○ | x | ○ | x | ○ |
| 20 | Δ | Δ | x | x | x | x |
| 25 | Δ | Δ | x | x | x | x |
| 30 | Δ | Δ | x | x | x | x |
| 35 | Δ | Δ | x | x | x | x |

TABLE 10

| Energy density 5 kw/cm$^2$ | Radiation wave-length (μm) | | | | | |
|---|---|---|---|---|---|---|
| Pulse width (t) | Visibility evaluation | | Fogging evaluation | | Over-all evaluation | |
| (×$10^{-6}$ sec) | 9.3, 9.6 | 10.6 | 9.3, 9.6 | 10.6 | 9.3, 9.6 | 10.6 |
| 25 | x | x | — | — | x | x |
| 30 | ○ | x | ○ | — | ○ | x |
| 50 | ○ | x | ○ | — | ○ | x |
| 80 | ○ | x | ○ | — | ○ | x |
| 120 | ○ | x | ○ | — | ○ | x |
| 150 | ○ | x | ○ | — | ○ | x |
| 175 | ○ | x | ○ | — | ○ | x |

TABLE 10-continued

| Energy density 5 kw/cm$^2$ | Radiation wave-length (μm) | | | | | |
|---|---|---|---|---|---|---|
| Pulse width (t) | Visibility evaluation | | Fogging evaluation | | Over-all evaluation | |
| (×10$^{-6}$ sec) | 9.3, 9.6 | 10.6 | 9.3, 9.6 | 10.6 | 9.3, 9.6 | 10.6 |
| 200 | ○ | x | ○ | — | ○ | x |
| 250 | Δ | x | x | — | x | x |

TABLE 11

| Energy density 80 kw/cm$^2$ | Radiation wave-length (μm) | | | | | |
|---|---|---|---|---|---|---|
| Pulse width (t) | Visibility evaluation | | Fogging evaluation | | Over-all evaluation | |
| (×10$^{-5}$ sec) | 9.3, 9.6 | 10.6 | 9.3, 9.6 | 10.6 | 9.3, 9.6 | 10.6 |
| 25 | x | x | ○ | — | x | x |
| 30 | ○ | x | ○ | — | ○ | x |
| 50 | Δ | x | x | — | x | x |
| 80 | Δ | x | x | — | x | x |
| 120 | Δ | x | x | — | x | x |
| 150 | Δ | x | x | — | x | x |
| 175 | Δ | x | x | — | x | x |
| 200 | Δ | x | x | — | x | x |
| 250 | Δ | x | x | — | x | x |

TABLE 12

| Energy density 50 kw/cm$^2$ | Radiation wave-length (μm) | | | | | |
|---|---|---|---|---|---|---|
| Pulse width (t) | Visibility evaluation | | Fogging evaluation | | Over-all evaluation | |
| (×10$^{-5}$ sec) | 9.3, 9.6 | 10.6 | 9.3, 9.6 | 10.6 | 9.3, 9.6 | 10.6 |
| 25 | x | x | ○ | — | x | x |
| 30 | ○ | x | ○ | — | ○ | x |
| 50 | ○ | x | ○ | — | ○ | x |
| 80 | ○ | x | ○ | — | ○ | x |
| 120 | ○ | x | ○ | — | ○ | x |
| 150 | ○ | x | ○ | — | ○ | x |
| 175 | ○ | x | ○ | — | ○ | x |
| 200 | Δ | x | x | — | x | x |
| 250 | Δ | x | x | — | x | x |

Here, the testing results shown in Tables 1 through 12 are pigeonholed.

The marking pattern MP of the dot arrays comprising reasonable dots 16A can be formed in the area A without reduction in finished quality in the X-ray film 12 (evaluation sample 70), using laser beams LB in the 9-micrometer band with a wavelength λ of 9.3 μm or 9.6 μm for the pulse widths t within a range of equal to or larger than 3 μsec and smaller than 30 μsec. As shown in FIG. 5, in a coordinate system in which the pulse widths t (μsec) and the energy densities E (kw/cm$^2$) are plotted in the abscissa and the ordinate, respectively, the area A is between a line segment $A_1$ and a line segment $A_2$; it is difficult in an area in which the energy density E is lower than the line segment $A_1$ to impart enough energy to the X-ray film 12; and, when the energy density E is higher than the line segment $A_2$, the energy amount becomes too, thereby causing large exposure, fogging, and the like in the base layer 14.

On the other hand, the energy density E of the laser beams LB on the evaluation sample 70 (X-ray film 12) can be expressed by an approximation based on the following linear function with a variable of the pulse width t as the radiation time of the laser beams LB.

$$E=\alpha t+\beta$$

(wherein, α and β are constants)

Accordingly, the following relationships for the line segments $A_1$, $A_2$ are derived:

$$A_1: E=\alpha_1 t+\beta_1, \text{ and}$$

$$A_2: E=\alpha_2 t+\beta_2$$

Thus, the following values are obtained from the above-described testing results: $\alpha_1=-10$; $\beta_1=330$; $\alpha_2=-15$; and $\beta_2=1000$.

Accordingly, when the laser beams LB of the 9-micrometer band are used, the marking pattern MP with excellent visibility can be formed without causing degradation in the product quality of the X-ray film 12 by setting the pulse widths t and the energy densities E such that, for the pulse widths t within a range of equal to or larger than 3 μsec and smaller than 30 μsec, $$E=\alpha_1 t+\beta_1$$

$$E=\alpha_2 t+\beta_2$$

wherein, $\alpha_1=-10$, $\beta_1=330$, $\alpha_2=-15$, $\beta_2=1000$.

Moreover, when the laser beams LB of the 10-micrometer band having, for example, a wavelength λ (μm) of 10.6 μm are used, the area B defined by line segments $B_1$, $B_2$ is set for the pulse widths t (μsec) within a range of equal to or larger than 3 μsec and smaller than 30 μsec.

At this time, when the line segments $B_1$, $B_2$ are as follows:

$$B_1: E=\alpha_3 t+\beta_3$$

$$B_2: E=\alpha_4 t+\beta_4,$$

the following values are obtained from the above-described testing results: $\alpha_3=-15$; $\beta_3=1000$; $\alpha_4=-25$; and $\beta_4=1450$.

Accordingly, when the laser beams LB of the 10-micrometer band are used, the marking pattern MP with excellent visibility can be formed without causing degradation in the product quality of the X-ray film 12 by setting the pulse widths t and the energy densities E such that, for the pulse widths t within a range of equal to or larger than 3 μsec and smaller than 30 μsec, $$E=\alpha_3 t+\beta_3$$

$$E=\alpha_4 t+\beta_4$$

wherein, $\alpha_3=-15$, $\beta_3=1000$, $\alpha_4=-25$, $\beta_4=1450$.

In the above-described areas A, B, the marking pattern MP with excellent visibility can be formed without causing deviation or absence of the dots 16A when the linear velocity of the X-ray film 12 is increased, and the productivity for forming the marking pattern MP on the X-ray film 12 can be improved, because the pulse widths t are within a extremely short range of equal to or larger than 3 μsec and smaller than 30 μsec, At this time, the line segment A1 as a boundary for the area A and the line segment B1 as a boundary for the area B coincide with each other. Thus, the productivity for marking on the X-ray film 12 can be improved on condition that, when an area AB (not shown) including the areas A, B is set, the wavelengths λ, the pulse widths t, and the energy densities E of the laser beams LB are set within the area AB defined by the line segments $A_1$, $B_2$ for the pulse widths t within a range of equal to or larger than 3 μsec and smaller than 30 μsec.

On the other hand, when the pulse widths t (μsec) are within a range of equal to or larger than 3 μsec and smaller than 30 μsec, the marking pattern MP can be formed on the X-ray film 12 by using the laser beams LB of the 9-micrometer band having, for example, a wavelength λ (μm) of 9.3 μm or 9.6 μm.

When an area C is defined as being between line segments $C_1$, $C_2$, the line segments $C_1$, $C_2$ are expressed as follows:

$C_1$: $E=\alpha_5 t+\beta_5$; and $C_2$: $E=\alpha_6 t+\beta_6$.

Accordingly, the following values are obtained from the above-described testing results: $\alpha_5=-0.03$; $\beta_5=10$; $\alpha_6=-0.35$; and $\beta_6=110$.

Therefore, when the pulse widths t are comparatively long (within a range of equal to or larger than 30 μsec and smaller than 200 μsec), by suppressing the energy density E and using the laser beams LB of the 9-micrometer band, the marking pattern MP with excellent visibility can also be formed without causing degradation in the product quality of the X-ray film 12 by setting the pulse widths t and the energy densities E such that the widths t and the densities E meet requirements based on the area C defined by the following relations:

$E=\alpha_1 t+\beta_1$; and $E=\alpha_2 t+\beta_2$, wherein, $\alpha_5=-0.03$, $\beta_5=10$, $\alpha_6=-0.35$, and $\beta_6=110$.

Here, the above-explained embodiment does not limit the configuration of the invention. Although, for example, the example of the marking device 10 has been explained in the embodiment, the invention is not limited to the above-described example and can be applied to a marking device with an arbitrary configuration in which the marking pattern comprising the dot arrays is formed by irradiating the laser beams LB onto the X-ray film 12, which is being carried, by on-off operation of a laser oscillation unit.

Moreover, the example in which the X-ray film 12 is used as the photosensitive material has been explained in the embodiment, but the invention is not limited to the above-described embodiment, and can be applied to marking on photosensitive materials with various kinds of configurations in which the emulsion layer is provided on at least one side of a support.

As explained above, the invention has an excellent advantage in that productivity can be improved by using laser light for marking on the photosensitive material because dots with excellent visibility can be formed on the condition that the pulse widths t (μsec) as the radiation time of laser light for forming individual dots are within a range of equal to or larger than 3 μsec and smaller than 30 μsec. Furthermore, a marking pattern with excellent visibility can be formed on a photosensitive material even for the pulse widths t (μsec) within a range of equal to or larger than 30 μsec and smaller than 200 μsec, according to the invention.

Incidentally, the radiation time of the laser beams LB for forming dots 16A with excellent visibility on the X-ray film 12 is within a range of 1 μsec to 15 μsec for the 9-micrometer band, for example, for 9.3 μm, or 9.6 μm as the oscillation wavelength (the wavelengths of the laser beams LB) of the laser oscillation unit 44. Here, when the oscillation wavelength of the laser oscillation unit 44 is in the 10-micrometer band, such as 10.6 μm, the above-described dots 16A can be formed by setting the radiation time of the laser beams LB within a range of 5 μsec to 18 μsec, but, in the embodiment, the laser oscillation unit 44 for oscillating the laser beams LB of a wavelength of the 9-micrometer band is used in order to improve the operation efficiency (marking efficiency).

Moreover, it is preferable that there is no space between the base layer 14 and the emulsion layer 16 of the X-ray film 12 by further control of the radiation time of the laser beams LB. This space is different from the air bubbles generated in the emulsion layer 16 when the dots 16A is formed. When the space is generated between the base layer 14 and the emulsion layer 16, the visibility of the laser beams LB is increased at a point at which the dots 16A are formed by irradiating the laser beams LB. However, the emulsion layer 16 on the upper side of the space is scattered by developing processing of the X-ray film 12 to provide an opening in the emulsion layer 16 and thereby cause an equivalent state to that in which the dots 16A are formed by the radiation for longer than the above-described radiation time (15 μsec for the 9-micrometer band, or 18 μsec for the 10-micrometer band).

Preferably, the radiation time of the laser beams LB is controlled within a range of 1 μsec to 10 μsec for the 9-micrometer band, and 5 μsec to 18 μsec for the 10-micrometer band as an oscillation wavelength in order to prevent generation of such a space between the base layer 14 and the emulsion layer 16 of the X-ray films 12. As a result, difference in the visibility between evaluation of the marking pattern MP at a manufacturing step of the X-ray film 12 and that by users can be reduced.

Although, at this time, there is little difference in the radiation time of the laser beams LB between the 9-micrometer band and the 10-micrometer band as the wavelength of the laser beams LB, the protruding amount of the dots 16A formed by the laser beams LB with a wavelength in the 10-micrometer band is about two times that of the dots 16A formed by the laser beams LB with a wavelength in the 9-micrometer band. Accordingly, it is preferable from a viewpoint of the visibility of the dots 16A to use the laser beams LB with a wavelength in the 9-micrometer band, and the laser oscillation unit 44 for oscillating the laser beams LB with a wavelength in the 9-micrometer band is used in the embodiment.

On the other hand, temperature increase is caused in the X-ray film 12 because the X-ray film 12 is heated by radiation of the laser beams LB. At this time, defective performance, such as sensitization and desensitization, is caused on the x-ray film 12 because a state in which the temperature is increased is maintained.

Moreover, the heat of the X-ray film 12 is transferred to the outer peripheral part of the print roller 24 onto which the X-ray film 12 wound. When the heat is accumulated in the print roller 24, the X-ray film 12 is heated by the print roller 24 to cause defective performance such as sensitization and desensitization on the X-ray film 12.

Here, the marking device 10 according to the embodiment has a configuration in which the outer peripheral part of the print roller 24 with which the X-ray film 12 comes into contact when the laser beams LB are irradiated is formed of metal with a thermal conductivity of 15 w/(m·K) or more, and the accumulation amount of the heat transferred from the X-ray film 12 in the outer part of the print roller 24 is suppressed by improving the heat dispersion characteristics of the outer peripheral part of the print roller 24. Furthermore, the heat in the X-ray film 12 can also be discharged with the print roller 24 by improving the heat dispersion characteristics of the outer peripheral part of the print roller 24.

As shown in FIG. 3, the embodiment has a configuration in which, the print roller 24 is formed like a cylinder with the hollow inside and the outer peripheral part onto which the X-ray film 12 is wound. At this time, in the embodiment, the outer peripheral part of the print roller 24 is formed of, as one example, SUS (stainless steel) with a thermal conductivity a of 15 w/(m·K). Here, in the embodiment, the surface of the outer peripheral part of the print roller 24 has a configuration in which the surface is plated with hard chromium (thermal conductivity: 90.3 W/(m·K)) to provide the surface with a surface roughness of 4 S or less, and, when the X-ray film 12 is wound onto the surface, generation of damage such as abrasion marks on the X-ray film 12 is prevented.

When, while the X-ray film 12 is carried, the X-ray film 12 is wound onto the print roller 24, air around the surface of the X-ray film 12 or around the outer peripheral surface of the print roller 24 is entrained as so-called entrained air between the X-ray film 12 and the outer peripheral surface of the print roller 24 to form an air layer between the print roller 24 and the X-ray film 12 which is wound onto the print roller 24.

The air layer has an adiabatic effect between the X-ray film 12 and the print roller 24 to cause reduction in the heat dispersion from the X-ray film 12.

That is, the air layer is formed between the X-ray film 12 and the print roller 24 by the entrained air to reduce a contact heat transfer coefficient H and the heat dispersion efficiency of the X-ray film 12 is decreased.

The amount of the entrained air is reduced by decreasing the linear velocity of the X-ray film 12, and by increasing the web tension of the X-ray film 12 which is wound onto the print roller 24. Accordingly, the decrease in the contact heat transfer coefficient H can be suppressed by decreasing the amount of the entrained air as described above.

As a result, in the marking device 10, the linear velocity V or the web tension T of the X-ray film 12 at the time of irradiating the laser beams LB is set in such a way that the contact heat transfer coefficient H of the X-ray film 12 is 475 $W/(m^2 \cdot K)$ or more, and preferably 480 $W/(m^2 \cdot K)$ or more.

Incidentally, the emulsion layer 16 is melted by irradiating the laser beams LB to form the dots 16A in the X-ray film 12. At this time, a position at which the laser beams LB are irradiated is heated on the X-ray film 12.

When the temperature of the X-ray film 12 is increased by the heat, defective performance as a photosensitive material, such as sensitization and desensitization, is caused.

Moreover, when the heat generated in the X-ray film 12 is transferred to the print roller 24 and is accumulated there to cause a temperature increase in the outer peripheral part of the print roller 24, the X-ray film 12 is heated by the print roller 24 to cause the defective performance such as sensitization and desensitization.

As a result, the marking device 10 has a configuration in which, while accumulation of heat in the print roller 24 is prevented by using metal with a high thermal conductivity a for the outer peripheral part of the print roller 24, generation of the defective performance such as sensitization and desensitization on the X-ray film 12 which is heated with the laser beams LB is prevented by heat dispersion of the X-ray film 12, using the print roller 24.

Table 1 shows testing results with regard to the thermal conductivity α of the outer peripheral part of the print roller 24, the surface temperature of the roller 24, and the finished-quality evaluation of the X-ray film 12, when a predetermined marking pattern MP is formed on the X-ray film 12 by irradiating the laser beams LB.

Here, evaluation for the print quality (finished quality) is made, and the results are expressed as follows:

○: no defective performance in the X-ray film is caused and high-quality marking patterns are formed; and X: defective performance such as sensitization and desensitization is caused.

TABLE 13

| Material for outer peripheral part of print roller | Thermal conductivity α (W/(m · K)) | Surface temperature of print roller (° C.) | Print quality |
|---|---|---|---|
| SUS | 15 | 35-45 | ○ |
| Iron | 80 | 35-40 | ○ |
| Aluminum | 237 | 25-30 | ○ |
| Copper | 398 | 23-28 | ○ |
| Glass reinforced resin | 0.5 | 70-80 | x |
| Chloroprene rubber | 0.25 | 80-90 | x |
| Acrylic rubber | 0.27 | 80-90 | x |

As described above, since the outer peripheral part of the print roller 24 is formed of a metal material with a thermal conductivity α of 15 W/(m·K) or more, such as SUS (stainless steel), iron, aluminum, and copper, and heat generated by radiation of the laser beams LB is dispersed from the X-ray film 12, whereby the heat is never accumulated, the marking pattern MP with excellent visibility can be formed without causing defective performance such as sensitization and desensitization in the X-ray film 12.

Here, a material preferable for forming the outer peripheral part of the print roller 24 is not limited to the metal materials shown in Table 13, and an arbitrary material with a thermal conductivity a of 15 W/(m·K) or more may be applied.

On the other hand, the contact heat transfer coefficient H between the X-ray film 12 and the print roller 24 is effected by heat dispersion from the X-ray film 12 to the print roller 24, and when the contact heat transfer coefficient H is small, the temperature of the X-ray film 12 is increased when the laser beams LB are irradiated Table 15 shows results of temperatures which were measured for a marking part at which the marking pattern MP was formed by irradiating the laser beams LB onto the X-ray film 12 when the contact heat transfer coefficient H between the X-ray film 12 and the print roller 24 was changed.

TABLE 14

| | | Line speed V (m/min) | | | | | |
|---|---|---|---|---|---|---|---|
| | | 30 | 50 | 100 | 200 | 300 | 400 |
| Web tension T (kg/m) | 3 | 40 | 45 | 50 | 50 | 55 | 60 |
| | 5 | 35 | 38 | 45 | 45 | 55 | 58 |
| | 8 | 35 | 35 | 43 | 43 | 50 | 55 |
| | 10 | 35 | 35 | 38 | 43 | 50 | 55 |
| | 15 | 35 | 35 | 35 | 42 | 48 | 55 |
| | 20 | 35 | 35 | 35 | 38 | 45 | 48 |
| | 30 | 35 | 35 | 35 | 35 | 38 | 40 |
| | 50 | 35 | 35 | 35 | 35 | 35 | 35 |

As shown in Table 15, reduction in the contact heat transfer coefficient H causes the increase in the temperature of the marking part on the X-ray film 12.

Moreover, when, while the X-ray film 12 is carried, the x-ray film 12 is wound onto the print roller 24, entrained air enters between the X-ray film 12 and the print roller 24 to form an air layer between the X-ray film 12 and the outer peripheral surface of the print roller 24. The air layer causes reduction in the contact heat transfer coefficient H between the X-ray film 12 and the print roller 24.

Table 15 shows results of temperatures which were measured for the marking part in which the marking pattern MP was formed by irradiating the laser beams LB onto the X-ray film 12 when the linear velocity and the web tension were changed.

TABLE 15

| Convection heating coefficient H ($W/(m^2 \cdot K)$) | Temperature at marking part (° C.) |
|---|---|
| 465 | 48 |
| 407 | 55 |
| 349 | 58 |
| 290 | 58 |
| 232 | 60 |
| 174 | 65 |

As clearly shown in Tables 14 and 15, decrease in the linear velocity V, or increase in the web tension T causes reduction in the amount of the entrained air to make the contact heat transfer coefficient H between the X-ray film 12 and the print roller 24 larger. As a result, the temperature of the marking part on the X-ray film 12 decreases.

That is, the contact heat transfer coefficient H ($W/(m^2 \cdot K)$) is expressed by the following relationship, assuming that D (mm) is the outside diameter of the print roller 24, V (m/min) is the linear velocity of the X-ray film 12, and T (kg/m) is the web tension.

$$H=[a/[b\cdot(D/25.4)*\{(V/0.3048)/(0.056\times T)\}^{2/3}+C]]\cdot 1.16279$$

wherein a, b and c are constants, a=4.0 to 5.0, b=0.000004, and c=0.002 to 0.003.

The contact heat transfer coefficient H is changed according to the web tension T, the linear velocity V, and the outside diameter D of the print roller 24.

As a result, in the marking device 10, the contact heat transfer coefficient H between the X-ray film 12 and the print roller 24 is set in such a way that the temperature of the X-ray film 12 does not reach a temperature at which defective performance such as sensitization and desensitization is caused, and the linear velocity V of the X-ray film 12 and the web tension T are set in such a way that the above-described contact heat transfer coefficient H is obtained.

Table 16 shows the contact heat transfer coefficient H and the evaluation of the finished quality of the X-ray film 12 when the web tension T was changed while the linear velocity V of the X-ray film 12 was constant.

Moreover, Table 17 shows the contact heat transfer coefficient H and the evaluation of the finished quality when the linear velocity V was changed while the web tension T of the X-ray film 12 was constant.

TABLE 16

| Web tension T (kg/m) | Contact heat transfer coefficient h | Print quality (finished quality) |
|---|---|---|
| 4 | 431.2 | x |
| 5 | 480.0 | ○ |
| 7 | 556.3 | ○ |
| 8 | 588.4 | ○ |
| 12 | 689.8 | ○ |

TABLE 16-continued

| Web tension T (kg/m) | Contact heat transfer coefficient h | Print quality (finished quality) |
|---|---|---|
| 16 | 763.8 | ○ |
| 20 | 821.4 | ○ |

TABLE 17

| Line speed V (m/min) | Contact heat transfer coefficient H ($W/(m^2 \cdot K)$) | Print quality (finished quality) |
|---|---|---|
| 240 | 470.7 | x |
| 230 | 480.0 | ○ |
| 200 | 511.5 | ○ |
| 180 | 535.9 | ○ |
| 150 | 579.2 | ○ |

As shown in Table 16, the contact heat transfer coefficient H is increased when the web tension T of the X-ray film 12 is increased. Moreover, as shown in Table 17, the contact heat transfer coefficient H is decreased when the linear velocity V of the X-ray film 12 is increased.

Furthermore, high-quality finish is obtained for the X-ray film 12 with a contact heat transfer coefficient H of 480 $W/(m^2 \cdot K)$ or more, and sensitization and desensitization is caused for the X-ray film 12 with a contact heat transfer coefficient H of 470.7 $W/(m^2 \cdot K)$ or less. The linear velocity V for the above-described cases are 230 m/min and 240 m/min, respectively.

Moreover, Table 18 shows the contact heat transfer coefficient H and the evaluation of the finished quality of the X-ray film 12 when the outside diameter of the print roller 24 is changed. Here, the results in Table 6 were obtained while the linear velocity V and web tension of the X-ray film 12 were kept constant.

TABLE 18

| Outside diameter d of print roller D (mm) | Contact heat transfer coefficient H ($W/(m^2 \cdot K)$) | Print quality (finished quality) |
|---|---|---|
| 200 | 623.6 | ○ |
| 150 | 733.1 | ○ |
| 100 | 889.4 | ○ |
| 80 | 972.3 | ○ |
| 50 | 1130.3 | ○ |

As shown in Table 18, when the contact heat transfer coefficient H is large, the finished quality of the X-ray film 12 does not depend on the outside diameter D of the print roller 24.

As a result, high-quality marking can be realized without causing defective performance in the X-ray film 12 when the contact heat transfer coefficient H is 475 $W/(m^2 \cdot K)$ or more, and preferably 480 $W/(m^2 \cdot K)$ or more.

On the other hand, high-quality marking can be realized without causing defective performance in the X-ray film 12 when the linear velocity V is 235 m/min or less, and preferably 230 m/min or less.

Furthermore, when the web tension T is 4.5 Kg/m or more, and preferably 5 Kg/m or more, high-quality marking can be realized without causing defective performance in theX-ray film 12.

Here, the upper limit of the web tension T may be controlled so as to be within a range in which no damage is caused in the X-ray film 12. Moreover, since reduction in the linear velocity V decreases the productivity for marking on the X-ray film 12, the linear velocity V may be set from the above-described range in such a way that a desired contact heat transfer coefficient H is obtained, based on the productivity, the time required for forming suitable dots 16A with the laser beams LB, and the like.

As a result, when the dots 16A are configured to be formed by irradiating the laser beams LB onto the X-ray film 12 to melt the emulsion layer 16 of the X-ray film 12, high-quality marking can be realized without causing defective performance as a photosensitive material, such as sensitization and desensitization, in the X-ray film 12.

Here, the above-explained embodiment does not limit the configuration of the invention. Although, for example, $CO_2$ laser beams have been used as the laser beams LB in the embodiment, the invention is not limited to the embodiment, and arbitrary laser light can be applied. Moreover, though the X-ray film 12 has been used as one example of the photosensitive material in the embodiment, the invention is not limited to the embodiment, and can be applied to marking on an arbitrary photosensitive material with the laser beams LB.

Furthermore, although, in the embodiment, the X-ray film 12 has been used for explanation of a web-like material to be printed, the invention is not limited to the X-ray film 12, and can be applied to an arbitrary web-like material to be printed if the material is formed of an arbitrary material in which the finished quality depends on increase in the surface temperature when the marking pattern MP is formed by heating the surface with the laser beams LB.

At this time, the thermal conductivity $\alpha$ and the contact heat transfer coefficient H of the print roller 24 as a backup roller may be set according to the material to be printed. As a result, high-quality marking with excellent visibility can be realized without reduction in finished quality of the material to be printed.

As explained above, according to the invention, the heat dispersion efficiency of a backup roller, onto which a material to be printed is wound, is increased by using a component material with a heat transfer coefficient of 15 W/m×K or more to suppress increase in the temperature of the material to be printed, when a marking pattern is formed by irradiating laser light for heating while the web-like material to be printed, in which the finished quality as a product depends on the temperature of, for example, a photosensitive material, is being carried.

As a result, an excellent advantage in that high-quality marking can be realized without reduction in finished quality of the material to be printed is obtained.

Moreover, reliable heat dispersion for the material to be printed can be realized by making the contact heat transfer coefficient H between the material to be printed and the backup roller 475 ($W/m^2 \times K$) or more, and preferably 480 ($W/m^2 \times K$) or more.

What is claimed is:

1. A method for laser marking in which a predetermined array of dots for forming a marking pattern are formed by irradiating a photosensitive material with a laser beam oscillated through a laser oscillation device, wherein when a wavelength $\lambda$ of the laser beam is within a range of equal to or larger than 9 μm and smaller than 10 μm, and a pulse width t for driving the laser oscillation device in order to form one dot is within a range of equal to or larger than 3 μsec and smaller than 30 μsec, an energy density E ($kw/cm^2$) of the laser beam on the photosensitive material and the pulse width t are set in an area defined by the following relations:

$$E=-10t+330, \text{ and}$$

$$E=-15t+1000;$$

wherein said irradiating a photosensitive material deforms said photosensitive material to form dots having a convex surface; and said dots comprise a plurality of small bubbles beneath the surface of the photosensitive material.

2. The method of claim 1, wherein said dots have a maximum height of approximately 10 μm.

3. The method of claim 2, wherein said bubbles have diameters between approximately 1 μm and 5 μm.

4. The method of claim 3, wherein said dots have a diameter of approximately 200 μm.

5. A method for laser marking in which a predetermined array of dots for forming a marking pattern are formed by irradiating a photosensitive material with a laser beam oscillated through a laser oscillation device, wherein when a wavelength $\lambda$ of the laser beam is within a range of equal to or larger than 10 μm and smaller than 11 μm, and a pulse width t for driving the laser oscillation device in order to form one dot is within a range of equal to or larger than 3 μsec and smaller than 30 μsec, an energy density E ($kw/cm^2$) of the laser beam on the photosensitive material and the pulse width t are set in an area defined by the following relations:

$$E=-15t+1000, \text{ and}$$

$$E=-25t+1450;$$

wherein said irradiating a photosensitive material deforms said photosensitive material to form dots having a convex surface; and said dots comprise a plurality of small bubbles beneath the surface of the photosensitive material.

6. The method according to one of claims 1 and 5, wherein the laser beam is irradiated while the photosensitive material is being conveyed.

7. The method of claim 5, wherein said dots have a maximum height of approximately 10 μm.

8. The method of claim 7, wherein said bubbles have diameters between approximately 1 μm and 5 μm.

9. The method of claim 8, wherein said dots have a diameter of approximately 200 μm.

10. A method for laser marking in which a predetermined array of dots for forming a marking pattern are formed by irradiating a photosensitive material with a laser beam oscillated through a laser oscillation device, wherein when a wavelength $\lambda$ of the laser beams is within a range of equal to or larger than 9 μm and smaller than 10 μm, and a pulse width t for driving the laser oscillation device in order to form one dot is within a range of equal to or larger than 30 μsec and smaller than 200 μsec, an energy density E ($kw/cm^2$) of the laser beams on the photosensitive material and the pulse width t are set in an area defined by the following relations:

$$E=-0.03t+10, \text{ and}$$

$$E=-0.35t+110;$$

wherein said irradiating a photosensitive material deforms said photosensitive material to form dots having a convex surface; and said dots comprise a plurality of small bubbles beneath the surface of the photosensitive material.

11. The method of claim 10, wherein said dots have a maximum height of approximately 10 μm.

12. The method of claim 11, wherein said bubbles have diameters between approximately 1 μm and 5 μm.

13. The method of claim 12, wherein said dots have a diameter of approximately 200 μm.

* * * * *